United States Patent [19]

Fujita et al.

[11] 4,062,742

[45] Dec. 13, 1977

[54] ZINC PLATING PROCESS

[75] Inventors: Shigeru Fujita, Omiya; Koichi Murayama, Tokyo; Toyohito Kaneda, Yono; Susumu Harada, Tokyo; Toshio Ueda, Koriyama, all of Japan

[73] Assignees: Kabushiki Kaisha Japan Metal Finishing Co., Tokyo; Nitto Boseki Kabushiki Kaisha, Fukushima, both of Japan

[21] Appl. No.: 775,323

[22] Filed: Mar. 7, 1977

[30] Foreign Application Priority Data

Mar. 9, 1976 Japan .....51-25401

[51] Int. Cl.[2] ..... C25D 3/22

[52] U.S. Cl. ..... 204/55 R; 260/29.2 R

[58] Field of Search ..... 204/55 R, 55 Y, 43 Z, 204/114, DIG. 2; 260/29.2 R

[56] References Cited

U.S. PATENT DOCUMENTS 4,030,987 6/1977 Fujita et al. ..... 204/55 R

*Primary Examiner*—G. L. Kaplan

[57] ABSTRACT

Zinc plating process comprising adding water-soluble, amphoteric polysulfone compounds having the formula (A) as set forth below and, optionally, aromatic aldehydes to a zinc plating bath of an alkali zincate type and subjecting the resulting bath to electrodeposition conditions. The Amphoteric polysulfone compounds have the formula (A)

wherein: $R_1$ and $R_2$ each independently represents a straight or branched chain alkyl group having from 1 to 4 carbon atoms or a 2-hydroxyethyl group; $a$ is in the range of 0.03 to 0.5; $b$ is in the range of 0.3 to 0.77; $c$ is in the range of 0.2 to 0.4, provided that $c$ is not greater than $b \times 0.8$; and $n$ is in the range of 5 to 100.

5 Claims, 2 Drawing Figures

ZINC PLATING PROCESS

BACKGROUND OF THE INVENTION

The present invention relates generally to zinc plating techniques. More specifically, it is concerned with a process for carrying out zinc plating by using a plating bath capable of forming a good plated surface in the absence of cyanic compounds.

Conventional zinc electroplating processes are generally classified into a strong alkali type process using cyanic compounds as a primary constituent and an acid type process using zinc chloride or zinc sulfate as a primary constituent. Of these, a strong alkali type plating process using a plating bath containing cyanic compounds, especially a large amount of sodium cyanide and soluble zinc compounds is most widely used at present.

It is known that such a strong alkali type plating process can provide a zinc plated surface having smoothness and semi-gloss because it uses a large amount of sodium cyanide. It is also known that if a very small amount of brighteners such as gelatin, peptone, sodium sulfide, thiourea, polyvinyl alcohol, aldehydes, ketones or salts of organic acids is added singly or together with other components to the plating bath, the resulting plated article has as even better surface.

However, because the alkali type plating process uses a large amount of cyanic compounds, which are themselves toxic materials, it is impossible to discharge the waste solution as such. For this reason, the alkali type plating process has a large number of disadvantages such as the requirement of vast facilities for treating the waste solution, the use of a large quantity of chemicals for treating the waste solution, unfavorable operation conditions, and the occurrence of public pollution. Therefore, the use of a plating bath containing cyanic compounds is nowadays impracticable from the standpoint of operative efficiency and economy.

More particularly, because zinc electroplating is applied directly onto ferrous materials in most cases, the iron is dissolved in large amounts in these zinc plating baths containing cyanic compounds. Especially, a ferro ferricyanide complex salt composed of cyan and iron is very stable and cannot easily be decomposed into free cyan. In general, a two-stage process using a chlorine method is applied for the treatment of waste water containing cyanic compounds. However, in accordance with this process, it is impossible to completely decompose the iron complex salt by using an existing treatment technique.

Under these circumstances, attention is being paid to alkali type zinc plating processes using no cyanic compound. Typical of these processes is a zinc plating process using sodium zincate and an excessive amount of sodium hydroxide. However, when zinc plating is carried out in this plating bath, a glossless and spongy zinc coating is deposited which leads to a very poor surface of the film deposited on the substrate to be plated. In order to provide excellent surfaces of zinc plated articles, attempts have been made to add brighteners to these plating baths.

It is known that examples of suitable brighteners for such alkali zincate bath are salts of glycollic acid, alkanol amines, and alkylene amines such as ethylenediamine, triethylenetetramine and triethylenepentamine. These brighteners may be used along or in combination with aromatic aldehydes. However, even if such an alkylene amine brightener is added to the above mentioned plating bath, it is difficult to form a uniform and homogeneous depoint on the object to be plated. Further, because the plating conditions for obtaining a plated surface having good gloss are strict, such a plating process is impractical for industrial purposes.

It has been also found that a reaction product of amines and epoxy compounds such as epichlorohydrin is useful as a brightener for the alkali type zinc plating bath. This brightener is primarily a reaction product of epichlorohydrin and various amines.

For example, U.S. Pat. No. 2,860,089 discloses a reaction product of epichlorohydrin and ammonia or ethylenediamine and designates the product as polyepoxyamine. Also, U.S. Pat. No. 3,227,683 describes a reaction product of epichlorohydrin and hexamine.

Although the chemical structures of these brighteners are not clearly known, it is believed that they are resins in which the epoxy ring is open and contains a hydroxyl group, secondary and tertiary amino groups, and quaternary ammonium base. These brighteners have a significantly excellent effect on plating baths containing cyanic compounds.

Attempts have been made to add such brighteners to a plating bath containing no cyanic compound in order to provide improved glossiness. However, because the resulting film has a high hardness, peeling of the deposited film often occurs during the processing of a plated article. Further, the glossiness of the film surface is not greatly improved and the deposition rate of the film is slow. For these reasons, the above mentioned plating process is feasible on a laboratory scale but is not applicable to industrial mass production. In addition, it is difficult to obtain uniformity in glossy surface as compared with a plating method using a plating bath containing cyanic compounds. Moreover, the deposit produced at a low current has no gloss. These results indicate that such a plating process is not suitable for a rack type plating operation.

SUMMARY OF THE INVENTION

It is an object of the present invention to provide a zinc plating process using a plating bath containing a novel brightener which is capable of providing uniformity in deposition and a gloss range and stability of a film which are equal to or superior to those obtained by a plating bath containing cyanic compounds.

As a result of our studies, it was found that the above object could be achieved by adding amphoteric polysulfone compounds having the formula (A) as set forth below and, optionally, aromatic aldehydes to a zinc plating bath of an alkali type and subjecting the resulting bath to electrodeposition conditions.

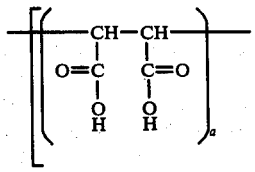

-continued

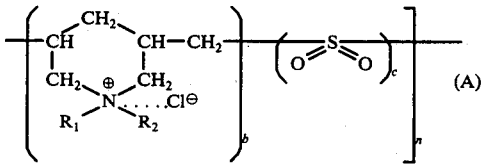

(A)

Wherein: $R_1$ and $R_2$ each independently represents a straight or branched chain alkyl group having from 1 to 4 carbon atoms or 2-hydroxyethyl group; $a$ is in the range of 0.03 to 0.5 (i.e., $0.03 \leqq a \leqq 0.5$); $b$ is in the range of 0.3 to 0.77 (i.e. $0.3 \leqq b \leqq 0.77$); $c$ is in the range of 0.2 to 0.4 (i.e. $0.2 \leqq c \leqq 0.4$), provided that $c$ is not greater than $b$x0.8, and $n$ is in the range of about 5 to about 100.

The zinc plating process of the present invention provides a deposited film which has high ductility and has gloss and smoothness which are equal to or superior to a film deposited by a plating bath containing cyanic compounds. Furthermore, in accordance with the plating process of the present invention, the deposition rate of a zinc film is favourably fast. In addition, the present process is advantageous in that it requires no vast facilities for treating waste solutions and causes no deterioration of the work environment and pollution because it uses no cyanic compounds.

DETAILED DESCRIPTION

Figure 1:
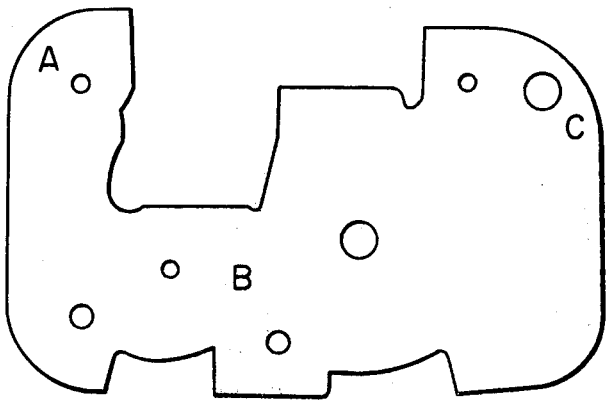
FIG. 1 is a plane view of the substrate to be plated used in Example 7 of the present invention.

The amphoteric polysulfone compound having the formula (A) which may be used in the present invention can be prepared by radical copolymerizing dialkyldiallyammonium compounds having the formula (I), maleic anhydride having the formula (II), or maleic acid having the formula (III) and sulfur dioxide ($SO_2$) as set forth below.

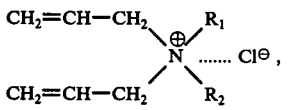

(I)

wherein $R_1$ and $R_2$ each independently represents a straight or branched chain alkyl group having from 1 to 4 carbon atoms or 2-hydroxyethyl group.

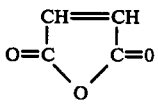

(II)

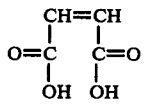

(III)

Both the maleic anhydride and the maleic acid may be used. But, as the copolymerization is carried out in the presence of water as a solvent, the maleic anhydride, when used, is hydrolyzed into maleic acid which is introduced into the amphoteric polysulfone. In general, the maleic anhydride is used as a copolymerization component.

The composition of each of the monomer components of the amphoteric polysulfone compounds having the formula (A) has the following limits as indicated above. That is, the maleic acid component has a mole ratio $a$ of 0.03 to 0.5 (i.e., $0.03 \leqq a \leqq 0.5$). If the value of $a$ is less than 0.03, the resulting compound will possess none of the characteristic of an amphoteric polymer compound. On the other hand, when the value of $a$ is greater than 0.5, the preparation of the compound is very difficult and is not practical.

The mole ratio $b$ of the dialkyldiallyammonium salt (1) component is in a range of 0.5 to 0.77 (i.e., $0.5 \leqq b \leqq 0.77$). It is impossible to produce an amphoteric polysulfone compound wherein $b$ is less than 0.5.

The mole ratio $c$ of the sulfone component is in a range of 0.2 to 0.4 (i.e. $0.2 \leqq c \leqq 0.4$), provided that the value of $c$ is not greater than $b \times 0.8$. If the value of $c$ is less than 0.2, the resulting compound cannot provide a completely glossy surface. On the other hand, in the case where the value of $c$ is greater than 0.4 or $b \times 0.8$, the compound provides a deposited film with decreased ductility which leads to peeling of the film from the plated substrate.

Examples of the compounds having the formula (1) which may be used in the preparation of the amphoteric polysulfone compound having the formula (A) of the present invention are dimethyldiallylammonium chloride, diethyldiallylammonium chloride, di-n-propyl-diallylammonium chloride, di-isopropyl-diallylammonium chloride, di-n-butyl-diallylammonium chloride, di-tert-butyl-diallylammonium chloride, methylethyl-diallylammonium chloride methyl-n-propyl-diallylammonium chloride, ethyl-n-propyldiallylammonium chloride, methyl-(2-hydroxy)-ethyldiallyammonium chloride, ethyl-(2-hydroxy)-ethyldiallylammonium chloride, and di-(2-hydroxyethyl)-diallylammonium chloride.

For reference purpose, an illustrative example of the preparation process for an amphoteric polysulfone compound having the formula (A) which may be used in the process of the present invention will be described below.

Into a four-neck, round-bottomed flask having a capacity of 500 cc and provided with a stirrer, a thermometer, a reflux condneser and a gas inlet tube are placed 87 g of dimethyl diallyammonium chloride and 12g of maleic anhydride, and 122g of water is then added to this flask with stirring to form a homogeneous solution. 23g of gaseous sulfur dioxide is blown into the solution while the temperature of the solution is maintained at a temperature not greater than 20° C. Then, a solution of 1g of ammonium persulfate, a polymerization catalyst, dissolved in 5g of water at a temperature of 20° C is added to the solution to effect the polymerization reaction under stirring. As the temperature rises with the addition of the catalyst solution, the flask is cooled from the outside so that the temperature of the content does not exceed 60° C.

When the evolution of heat of polymerization stops, and the temperature of the flask content begins to drop, a solution of 1.5 g of ammonium persulfate in 7.5 g of water is further added to continue the polymerization reaction under stirring at a temperature of 40° to 50° C for about 5 hours. Thus, a uniform and viscous solution is obtained. This solution is poured into a large amount of acetone to procipitate the resultant polymer. During this step, a small amount of unpolymerized monomers is dissolved in acetone and removed. The precipitated polymer is filtered off and, after washing with a sufficient amount of acetone, the polymer is dried at a temperature of 50° C under reduced pressure until the weight of the polymer becomes constant. The polymer so obtained is a white powder, and the yield is 118 g.

In one substance, this polymer was subjected to elementary analysis, infrared analysis, viscosity measurement, conductometric titration, and molecular wieght measurement. As a result, the polymer was found to be an amphoteric polysulfone compound having the following composition. The value of *n* for the degree of polymerization could not be determined accurately.

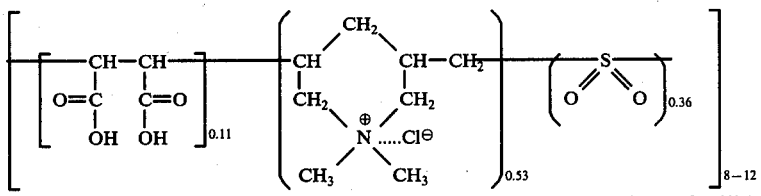

A-1

This amphoteric polysulfone compound is referred to as A-1 hereinafter for brevity. Following the same procedure as stated above, amphoteric polysulfone compounds A-2 through A-4 each having the compositions as described below were synthesized. These compounds are respectively referred to as A-2, A-3 and A-4 hereinafter for brevity.

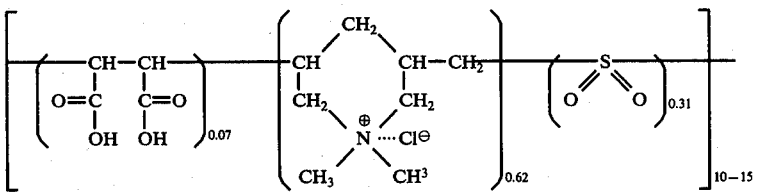

A-2

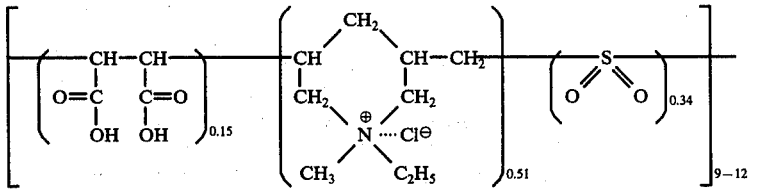

A-3

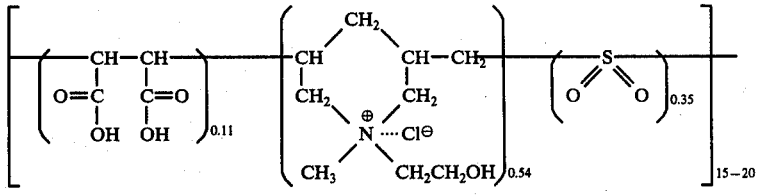

A-4

The degree of polymerization *n* of these amphoteric polysulfone compounds used in the present invention is in the range of 5 to 100. As the degree of polymerization increases, the gloss of the resulting deposit tends to be inferior. Particularly desirably, the degree of polymerization is in the range of 5 to 50.

These amphoteric polysulfone compounds are added to a zinc plating bath in the form of an aqueous solution thereof. Therefore, the aqueous solution of the aforementioned polysulfone compound resulting from the copolymerization may be suitably diluted with water and used as such. In addition, the amphoteric polysulfone compound can be used as a mixture with several kinds of the other polysulfone compounds.

It is evident that the quantity of amphoteric polysulfone compound added differs with factors such as the zinc plating bath to be used, the type of the amphoteric polysulfone compound, the desired property of a zinc deposit film. In general, when an alkali zinc plating bath containing sodium zincate and sodium hydroxide is used, it is desirable that the amphoteric polysulfone compound be added in a quantity of 0.1 to 10 g/l, particularly 1 to 5g/l, in the form of a 25 wt.% aqueous solution.

If the amphoteric polysulfone compound is used in a quantity greater than the upper limit, the gloss of the deposited film will become excellent, but the hardness thereof will be higher, and the workability will deteriorate. On the other hand, if the addition quantity of the amphoteric polysulfone compound is less than the lower limit, the objects of the present invention cannot be achieved.

An aromatic aldehyde which is compatible with the amphoteric polysulfone compound in the plating bath is added as necessary in order to improve the gloss of the film deposited on a substrate. Of course, the amphoteric polysulfone compound can provide sufficient gloss of the deposit. However, if one or more of the aromatic aldehyde compounds are included in the plating bath in combination with the amphoteric polysulfone compound, the gloss of the resulting deposit is improved over that obtained by the amphoteric polysulfone compound alone. The quantity of such aromatic aldehyde compound added varies with the type of the aromatic aldehyde compound, the desired gloss of the resulting deposit film, and other factors. Generally, the greater the addition quantity of the aromatic aldehyde compound, the better is the gloss of the resulting deposit film. For example, if methoxybenzaldehyde is used as the aromatic aldehyde compound, a quantity of 0.1 to 0.5 g/l is sufficient.

Principal examples of the aromatic aldehyde compound which can be used in combination with the amphoteric polysulfone compound in the present invention are o-hydroxybenzaldehyde, m-hydroxybenzaldehyde, p-hydroxybenzaldehyde, 3,4-dimethoxybenzaldehyde, 3,4-methylenedioxybenzaldehyde, methoxybenzaldehyde, p-aminobenzaldehyde, 3-methoxy-4-hydroxybenzaldehyde, 3-hydroxy-4-methoxybenzaldehyde, 3-methoxysalicylaldehyde, cinnamaldehyde, and tolylaldehyde. It is to be understood that the aromatic aldehyde compound used in the present invention is not limited to the above mentioned compounds.

The zinc plating bath to which the amphoteric polysulfone compound of the present invention is added may be basically, any alkaline bath containing zinc in a soluble state dispersed therein. For example, it is a solution consisting of zinc oxide and sodium hydroxide. In this solution, zinc is dispersed in the form of sodium zincate.

The conditions under which the zinc plating operation is carried out in this plating bath can be the same as those used when the plating is carried out in a conventional alkali plating bath containing cyanic compounds. For example, when tested according to a Hull cell method, a current density of 0.5 to 25A/dm$^2$ provides a zinc deposit film having a high gloss.

With the plating bath containing cyanic compounds, the temperature of the bath cannot exceed about 35° C. Further, when a zinc plating is carried out in the bath at a current density less than 1A/dm$^2$, the resulting deposit film is grey and completely deficient in gloss. This is because the temperature of the bath is higher than 35° C and, thus, the brightener contained in the bath decomposes. However, the amphoteric polysulfone compound used in the present invention does not decompose in the plating bath of the present invention even at a temperature greater than 40° C. Accordingly, the plating bath of the present invention can be used effectively even at a temperature greater than 40° C. For this reason, it is not necessary to employ a plating apparatus with a cooling means.

In order to indicate more fully the nature and utility of this invention, the following specific examples of practice are set forth, it being understood that these examples are presented as illustrative only and that they are not intended to limit the scope of the invention.

| Example 1 | |
|---|---|
| ZnO | 15 g/l |
| NaOH | 140 g/l |
| Amphoteric polysulfone A-1 a 25 wt. % aqueous solution | 10 g/l |

A plating bath having the above composition was prepared, and plating was carried out in a Hull cell testing apparatus. A steel plate was plated at a bath temperature of 25° to 28° C and with a total current of 2A for 10 minutes without agitation of the bath. At a current density greater than 3A/dm$^2$, the resultant deposit had a glossy surface; at a current density of 0.5 to 3A/dm$^2$, the resultant deposit had a semi-glossy surface; and at a current density less than 0.5A/cm$^2$, the resulting deposit had a grey surface.

| Example 2 | |
|---|---|
| ZnO | 15 g/l |
| NaOH | 140 g/l |
| Amphoteric polysulfone A-1 a 25 wt. % aqueous solution | 10 g/l |
| Methoxybanzaldehyde | 0.5 g/l |

A plating bath having tha above composition was prepared, and plating was carried out in a Hull cell testing apparatus. A steel plate was plated at a bath temperature of 25° to 28° C and with a total current of 2A for 10 minutes without agitation of the bath. At a wide range of current density of 0.5 to 15 A/dm$^2$, a zinc deposit having an excellent gloss and ductility was obtained.

| Example 3 | |
|---|---|
| ZnO | 15 g/l |
| NaOH | 140 g/l |
| Amphoteric polysulfone A-2 a 25 wt. % aqueous solution | 20 g/l |
| 3,4-methylenedioxybenzaldehyde | 0.5 g/l |

A plating bath having the above composition was prepared, and plating was carried out in a Hull cell testing apparatus. A steel plate was plated at a bath temperature of 25° to 28° C and with a total current of 2A for 10 minutes without agitation of the bath. At a current density of 2 to 15 A/dm$^2$, a zinc deposit having an excellent gloss and ductility was obtained.

| Example 4 | |
|---|---|
| ZnO | 15 g/l |
| NaOH | 150 g/l |
| Amphoteric polysulfone A-3 a 25 wt. % aqueous solution | 5 g/l |
| 3,4-dimethoxybenzaldehyde | 0.5 g/l |

A plating bath having the above composition was prepared, and plating was carried out in a Hull cell testing apparatus. A steel plate was plated at a bath temperature of 25° to 28° C and with a total current of 2A for 10 minutes without agitation of the bath. At a current density of 1 to 15 A/dm$^2$, a glossy deposit was obtained; at a current density of 0.2 to 1 A/dm$^2$, a semi-glossy deposit was obtained; and at a current density less than 0.2 A/dm$^2$, a grey deposit was obtained.

| Example 5 | |
|---|---|
| ZnO | 15 g/l |
| NaOH | 150 g/l |
| Amphoteric polysulfone A-4 a 25 wt. % aqueous solution | 10 g/l |
| p-hydroxybenzaldehyde | 0.5 g/l |

A plating bath having the above composition was prepared, and plating was carried out in a Hull cell testing apparatus. A steel plate was plated at a bath temperature of 25° to 28° C and with a total current of 1A and 2A, respectively, for 10 minutes without agitation of the bath. By the 1A, 10-minute plating, a glossy zinc deposit was obtained at a current density of 0.5 to 7.5 A/dm$^2$. By the 2A, 10-minute plating, a zinc deposit having an excellent gloss over the entire surface and good ductility was obtained.

| Example 6 | |
|---|---|
| ZnO | 10 g/l |
| NaOH | 130 g/l |
| Amphoteric polysulfone A-1 a 25 wt. % aqueous solution | 10 g/l |
| m-hydroxybenzaldehyde | 0.5 g/l |

A plating bath having the above composition was prepared, and plating was carried out in a Hull cell testing apparatus. A steel plate was plated at a bath temperature of 35° to 38° C and with a total current of 2A for 10 minutes without agitation of the bath. At a current density of 1 to 10A/dm², a glossy deposit was obtained, and at a current density less than 1 A/dm², a semi-glossy deposit was obtained.

| Example 7 | |
|---|---|
| ZnO | 10 g/l |
| NaOH | 130 g/l |
| Amphoteric polysulfone A-1 a 25 wt. % aqueous solution | 10 g/l |
| Methoxybenzaldehyde | 0.3 g/l |

A plating bath having the above composition was prepared. Six substantially flat steel plates having a complicated shape and provided with perforations at various point as shown in FIG. 1 were plated in the above specified bath under the plating conditions described below. The thickness of the resulting deposit at the peripheral portions of the plate as shown at A and C and the portion remote from the periphery as shown at B in FIG. 1 was measured, and, at the same time, the resulting deposit was tested for corrosion resistance.

The corrosion resistance test was conducted by using a brine spraying method according to Japanese Industrial Standard Z 2371.

| Plating conditions | |
|---|---|
| Volume of the bath | 250 l |
| Distance between zinc anode and cathode | 20 cm |
| Current density | 4A/dm² |
| Time | 15 minutes |
| Bath temperature | 35° C |

The steel plates so plated were washed with water, immersed in a 1% solution of nitric acid for 3 to 4 seconds, and then immersed in a yellow chromate finishing solution containing 5g of chromic anhydride per liter for 10 seconds. After immersing, the steel plates were dried and left to stand at room temperature for 3 days. At the end of that period, there specimens were subjected to the brine spraying test. The results are shown in Table 1. These results all satisfied the above mentioned standard.

Table 1

| | Thickness of deposit at three points | | | Time until a point of iron rust (red rust) appears | | | |
|---|---|---|---|---|---|---|---|
| Sample | A | B | C | 144 hrs. | 168 hrs. | 172 hrs. | 240 hrs. |
| No. 1 | 8.3 μ | 5.0 μ | 8.7 μ | None | None | None | None |
| 2 | 7.9 | 5.4 | 8.4 | " | " | " | " |
| 3 | 8.0 | 5.4 | 8.2 | " | " | " | " |
| 4 | 8.4 | 4.9 | 9.3 | " | " | " | Appeared |
| 5 | 7.5 | 5.6 | 7.8 | " | " | " | Appeared |
| 6 | 9.4 | 4.2 | 8.7 | " | " | " | None |

EXAMPLE 8

For the zinc plating, the plating rate is very important. This is because the formation of the required zinc deposit in a short period of time is advantageous from the standpoint of productivity.

The conventional zinc plating method using a plating bath containing sodium cyanide has a deposition rate of about 1 μ/minute at a current density of about 4A/dm², while a zinc plating bath containing no cyanic compound tends to provide a slower deposition rate.

The deposition rate of a zinc film was determined by using the plating baths 1, 2 and 3 indicated in Table 2. The deposition rate was determined by taking a Hull cell distribution. The Hull cell conditions were as follows:

| | |
|---|---|
| Volume of plating bath | 267 ml |
| Total current | 2A |
| Plating time | 5 minutes |
| Bath temperature | 25° C |

The thickness of the deposit films so produced were determined by using an electronic thickness tester manufactured by Kocoor Co. The results are shown in FIG. 2.

Table 2

| Composition of plating bath | Plating bath NO. 1 | 2 | 3 |
|---|---|---|---|
| ZnO | 15 g/l | | 42 g/l |
| NaOH | 130 g/l | 90 g/l | 75 g/l |
| NaCN | | 40 g/l | 83 g/l |
| $Zn(CN)_2$ | | 60 g/l | |
| $Na_2CO_3$ | | 80 g/l | |
| $Na_2S$ | | 1 g/l | |
| 1-benzyl-3-carbinol pyridinium chloride | | 0.8 g/l | |
| Polyvinyl alcohol | | 0.13 g/l | |
| N-benzyl-3-methylcarboxylate pyridinium chloride | | | 0.35 g/l |
| Amphoteric polysulfone A-2 (a 25% aqueous solution) | 20 g/l | | |
| Methoxybenzaldehyde | 0.5 g/l | | |

Figure 2:
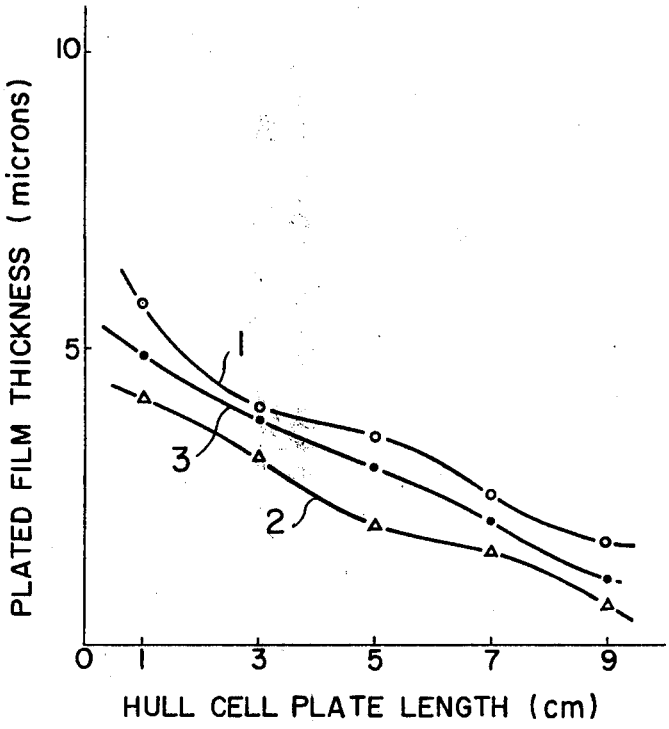
FIG. 2 is a graph illustrating a Hull cell distribution which shows a deposition rate of zinc measured in Example 8 of the present invention.

As can be seen from FIG. 2, the plating bath 1 of the present invention exhibits a deposition rate which is approximately equal to those of the conventional plating baths 2 and 3 each containing the cyanic compounds.

In the case of the zinc plating, when the plating is completed, the resultant plated article is generally subjected to a chromate treatment in order to improve the rust inhibiting property of the article. Since the plated article is subjected to a chemical polishing process during the chromate treatment, there exists no problem even if the surface of the zinc deposit is semi-glossy at the end of the plating operation. Accordingly, in the case of the zinc plating, if the zinc deposit has a degree of gloss higher than a semi-gloss grade, the degree of gloss of the deposit can be significantly enhanced during the chromate treatment depending upon the property of the solution used in that treatment.

Thus, in accordance with the present invention, it is possible to rapidly obtain a zinc deposit film having an excellent gloss without using cyanic compounds, and, thus, without being troubled by the treatment of a waste liquid containing the same. Accordingly, the present invention provides a very effective and convenient process for zinc plating.

We claim:

1. A zinc plating process comprising adding water-soluble, amphoteric polysulfone compounds and, optionally, aromatic aldehydes to a zinc plating bath of an alkalizincate type and subjecting the resulting bath to electrodeposition conditions, said amphoteric polysulfone compounds having the formula

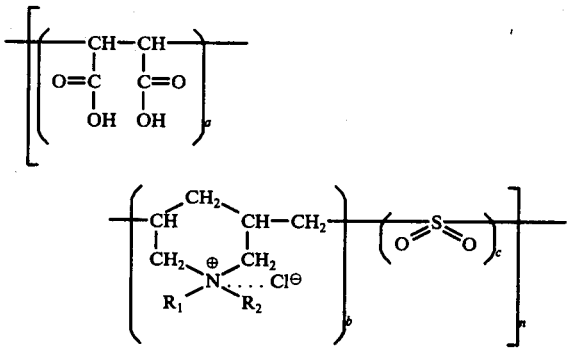

wherein: $R_1$ and $R_2$ each independently represent a straight or branched chain alkyl group having from 1 to 4 carbon atoms or 2-hydroxyethyl group; *a* is in the range of 0.03 to 0.5; *b* is in the range of 0.3 to 0.77, *c* is in the range of 0.2 to 0.4, provided that *c* is not greater than $b \times 0.8$; and *n* is in the range of about 5 to about 100.

2. The zinc plating process as claimed in claim 1 in which the aromatic aldehyde is an aldehyde selected from the group consisting of methoxybenzaldehyde, 3,4-methylenedioxybenzaldehyde, 3,4-dimethoxybenzaldehyde, p-hydroxybenzaldehyde, and m-hydroxybenzaldehyde.

3. The process as claimed in claim 1, wherein the amphoteric polysulfone compound is added in a quantity of 0.1 to 10g/l, in the form of a 25 wt. % aqueous solution.

4. The process as claimed in claim 1, wherein the electrodeposition is carried out at a current density of 0.5 to 25 A/dm$^2$.

5. The process as claimed in claim 1, wherein the amphoteric polysulfone compound is added in a quantity of 1 to 5 g/l in the form of a 25 wt. % aqueous solution.

* * * * *